US008434441B2

(12) United States Patent
Günthner et al.

(10) Patent No.: US 8,434,441 B2
(45) Date of Patent: May 7, 2013

(54) JOINING DEVICE FOR AN ACTUATING LEVER AND SUPPORTING ELEMENT OF A VALVE OPERATING MECHANISM OF AN INTERNAL COMBUSTION ENGINE

(76) Inventors: Manfred Günthner, Konnersreuth (DE); Martin Jäkel, Hirschaid (DE); Stephen Ernstberger, Waldershof (DE); Franz-Holger Woitowitz, Homburg (DE)

( * ) Notice: Subject to any disclaimer, the term of this patent is extended or adjusted under 35 U.S.C. 154(b) by 0 days.

(21) Appl. No.: 13/066,434

(22) Filed: Apr. 15, 2011

(65) Prior Publication Data

US 2011/0214527 A1 Sep. 8, 2011

Related U.S. Application Data

(63) Continuation of application No. 10/588,590, filed as application No. PCT/DE2005/000153 on Feb. 1, 2005, now abandoned.

(30) Foreign Application Priority Data

Feb. 6, 2004 (DE) ..... 10 2004 005 831
Feb. 1, 2005 (WO) ..... PCT/DE2005/075795

(51) Int. Cl.
*F01L 1/18* (2006.01)

(52) U.S. Cl.
USPC ..... 123/90.41; 123/90.44

(58) Field of Classification Search ..... 123/90.41, 123/90.43, 90.44, 90.45; 248/200, 228.7, 248/231.81, 316.7
See application file for complete search history.

(56) References Cited

U.S. PATENT DOCUMENTS

| | | | | |
|---|---|---|---|---|
| 3,235,209 | A * | 2/1966 | Seckerson et al. | 248/73 |
| 4,598,674 | A * | 7/1986 | Nono et al. | 123/90.41 |
| 4,676,203 | A * | 6/1987 | Nouno | 123/90.42 |
| 5,775,280 | A * | 7/1998 | Schmidt et al. | 123/90.41 |
| 6,047,675 | A * | 4/2000 | Kunz | 123/90.41 |
| 6,715,720 | B2 * | 4/2004 | Finn | 248/71 |
| 2007/0221154 | A1 * | 9/2007 | Smith et al. | 123/90.44 |

* cited by examiner

*Primary Examiner* — Alfred J Wujciak
(74) *Attorney, Agent, or Firm* — Horst M. Kasper

(57) ABSTRACT

A connecting device for the pivotal and loss-prevention joining of an actuating lever (1) and a support element (6) of a valve operating mechanism of a combustion engine. The actuating lever (1) has, in a supporting section (3), a spherical cap-shaped cavity (5) inside of which the spherical end (7) of the supporting element (6) may be placed. A recess and/or undercut (8) is formed underneath the spherical end (7) in the supporting element (6). The actuating lever (1) has, in the supporting section (3), a spherical upper surface (4) above the spherical cap-shaped cavity (5). A securing element (9) joins the actuating lever (1) and the supporting element (6) to one another. This securing element (9) has a U-shaped cross-sectional shape with an upper and a lower limb (10, 11) that are joined to one another via a joining section (12). Geometrically closed openings (13, 14) for accommodating the recess (8) of the supporting element (6) or the spherical upper surface (4) of the supporting section (3) of the actuating lever (1) are made in both limbs (10, 11). The opening (13) in the upper limb (10) is essentially round, and the opening (14), which is located in the lower limb (11) while being assigned to the supporting element (6), is provided, in essence, in the form of a slot.

19 Claims, 2 Drawing Sheets

JOINING DEVICE FOR AN ACTUATING LEVER AND SUPPORTING ELEMENT OF A VALVE OPERATING MECHANISM OF AN INTERNAL COMBUSTION ENGINE

This application is a continuation application of the patent application Ser. No. 10/588,590, filed on Sep. 25, 2006 now abandoned.

CROSS REFERENCE TO RELATED APPLICATIONS

The present application claims priority under 35 U.S.C. §120 to International Patent Application No. PCT/DE2005/000153, filed Feb. 1, 2005, entitled "Joining Device for an Actuating Lever and a Supporting Element of a Valve Operating Mechanism of an Internal Combustion Engine" and International Priority under 35 U.S.C. §119 to co-pending German Patent Application No. 10 2994 005 831.8, filed Feb. 6, 2004, entitled "Verbindungsvorrichtung für einen Betätigungshebel und ein abstützelement einer ventilsteuerung einer brennkraftmaschine"; the entire contents and disclosures of which are hereby incorporated by reference in its entirety.

TECHNICAL FIELD

The invention relates to a connection device for the pivotable and captive connection of a control lever and a support element of a mechanical valve controller of an internal combustion engine.

BACKGROUND

From U.S. Pat. No. 5,775,280, a connection device is known, wherein a control lever and a support element associated with the connection device are connected via a retaining element in a pivotable and captive manner. This connection device is especially advantageous because it avoids assembly problems in the manufacture of a mechanical valve controller of an internal combustion engine.

The retaining element known from this publication is designed as a sheet metal bracket, wire retaining clamp or plastic retaining cap, which engages into, among other things, an undercut in the support element below the spherical end of said support element. In the version of the sheet metal retaining bracket, to be explained in more detail in the following, this retaining element possesses an essentially U-shaped cross-sectional geometry and comprises two legs that are connected to each other via a connecting section. The first closed-surfaced leg is attached to the cam follower above a receiving calotte, while the second bifurcated leg engages into the undercut of the support element projecting into the calotte. Furthermore, both legs exhibit, on their free ends, retaining collars with which the retaining element may be clamped onto the cam follower as well as the support element in a captive manner.

Although this known connection device has a number of advantages, the fact that various adapted retaining elements are needed for different cam follower geometries still has to be considered as disadvantageous.

U.S. Pat. No. 6,047,675 and U.S. Pat. No. 6,543,402, respectively, also disclose other valve controllers for an internal combustion engine with these valve controllers also using wire-shaped retaining elements or retaining elements designed as sheet metal parts for the purpose of connecting the cam follower and the support element. The sheet metal retaining clamp is U-shaped in this case as well, with the two parallel running sheet metal legs being connected to each other via a connecting section.

Furthermore, contrary to U.S. Pat. No. 5,775,280, the two legs exhibit circular or U-shaped receiving openings in the area of their free ends. While the lower leg of this retaining element engages at the support element, the upper leg envelops, with its receiving opening, a portion of the spherical top side of that receiving calotte in which the also spherically shaped top side of the support element is supported in terms of a ball bearing.

Of special significance for the sheet metal retaining clamp, with the geometrically closed openings in the legs, is the fact that respective protrusions project into these receiving openings. The protrusions rest with a friction fit against the undercut-less cylindrical portion of the support element and holding it in a gripper-like manner, or being pressed onto the spherical top side of the support element.

A disadvantage of this type of connection device is that the support element is held only in a gripper-like manner and by friction fit by the sheet metal retaining clamp. Since there is no provision made for an engagement into an undercut (which does not exist in this case) of the support element, it has to be anticipated that the cam follower and the support element will fall apart in the event of heavy mechanical stress.

SUMMARY OF THE INVENTION

Against this background, various embodiments of the invention are based on the technical problem of creating a connection device for a connection between a cam follower and a support element, with said connection device being suited for different cam follower geometries in the connection area with the support element. Furthermore, various embodiments of this connection device are configured to ensure a secure, articulated, and captive connection between the cam follower and the support element even in the event of heavy mechanical stresses. And, finally, the retaining element of one embodiment of the connection device, which implements the mechanical connection between these two components, is configured to exhibit a low tendency to get stuck when stored with other retaining elements in a container, to be capable of being automatically mounted, and to be capable of being manufactured at low cost.

Although various embodiments of the invention are illustrated and described herein as embodied in a connection device and/or joining device, it is, nevertheless, not intended to be limited to the details shown because various modifications and structural changes may be made therein without departing from the spirit of various embodiments of the invention and remain within the scope and range of equivalents of the claims.

Accordingly, various embodiments of the invention relate to a connection device for the pivotable and captive connection of a control lever and an associated support element of a valve controller of an internal combustion engine. The control lever exhibits, in one supporting section, a calotte-shaped recess in which the spherical end of the support element is located. In the support element of the connection device, a notched recess or an undercut is located below a spherical end of the support element. In the control lever of the connection device, a supporting section above the calotte-shaped recess exhibits a spherical geometry. A retaining element of the connection device connects the control lever and the support element.

In accordance with a feature of one embodiment of the invention, the retaining element exhibits a U-shaped cross-sectional geometry with an upper and a lower leg being connected via a connecting section. There are also geometrically closed openings provided in the legs for the purpose of receiving the undercut of the support element or the spherical top side of the supporting section of the control lever, with the opening in the upper leg being essentially round and the opening in the lower leg being essentially slot-shaped.

In various embodiments of the invention the control lever is designed as a cam follower and the support element as an axially movable piston.

With respect to the retaining element, one embodiment considers having material thickness to be less than the width of the undercut to be advantageous so that the retaining element is freely movable in all pivot positions of the control lever in the undercut.

According to another embodiment of the retaining element, the legs and, specifically, the connecting section of the retaining element are smooth-surfaced, reducing the tendency toward jamming of such a retaining element in an assembly supply container and allowing easy placement onto the control lever and the support element. It is specifically the closed surface of the connecting section that allows this component part to be grasped with an automatic assembly vacuum gripper.

In particular, the placement of the retaining element onto the control lever between its side walls is facilitated if the legs of the retaining element exhibit lead-in chamfers in the area of their free ends, virtually sharpening these legs.

Another facilitation of assembly in putting together the control lever and the support element can be achieved in further developments of one embodiment of the invention by designing the free ends of the legs such that they point away from each other.

In the further development of one embodiment of the invention, the positioning of the retaining element on the support element is also benefited by the slot-shaped opening in the lower leg exhibiting a stadium-like geometry with two opening sections running parallel to each other and being connected by semi-circular opening sections.

The expansion of this opening in the lower leg, which is used for the placement of the retaining element onto the support element, is further facilitated if a slot-type extension of the opening with a preferably small opening width is provided in at least one of the above-mentioned semi-circular opening sections. This makes it easier for the sections of the lower leg to twist against each other during the axial placement onto the support element, causing the cross section of the opening to be briefly expanded. Following the above-mentioned placement, the originally smooth surface of the lower leg is reconverted so that this leg then engages into the undercut of the support element in a captive manner.

Furthermore, the opening in the upper leg of the retaining element is designed such that this leg is securely fastened on the spherical, e.g. ball-shaped head-type, top side of the supporting section of the control lever.

In accordance with another further development of one embodiment of the invention, it is provided that the width of the opening in the lower leg is smaller across its longitudinal extension than the diameter of the opening of the upper leg. The effect of this combination is that, given a preset undercut depth, sufficient retention is ensured on the spherical top side of the control lever, or that, given a preset diameter of the opening in the upper leg, a sufficiently large undercut depth is utilizable. To ensure a secure retention, it is essential that the width of the opening in the lower leg at a right angle relative to its longitudinal extension is smaller than the diameter of the support element above and below the undercut.

Furthermore, the design of this retaining element can also be such that the upper leg is axially shorter than the lower leg. This advantageously achieves a reduction of weight and costs as compared to legs of equal length, while the secure retention on the spherical top side of the supporting section of the control lever is ensured even when the retention element does not precisely envelop, with the opening of its top legs, the pole area of the spherical top side of the supporting section.

Another aspect concerns the distance of the two legs of the retaining element. Preferably, it is provided that the connecting radius between the lower leg and the connecting section is smaller than the connecting radius between the latter and the upper leg. This causes the retaining element to seat itself in the assembled state, i.e. slightly bent open, with its connecting section closely against the front side of the control lever as well as against the spherical top side of the supporting section.

And finally, various embodiments of the invention provide for the distance between the lower leg and the upper leg of the retaining element to be greater in the vicinity of the connecting section than in the area of the free end of the two legs. This has the effect that, given selection of a suitable preferably sheet metal material for the retaining element, the control lever and the support lever are held together in the assembled state by an increased elastic retention force.

BRIEF DESCRIPTION OF THE DRAWINGS

The present invention will be described by way of exemplary embodiments, but not limitations, illustrated in the accompanying drawings in which like references denote similar elements, and in which.

DETAILED DESCRIPTION

Figure 1:
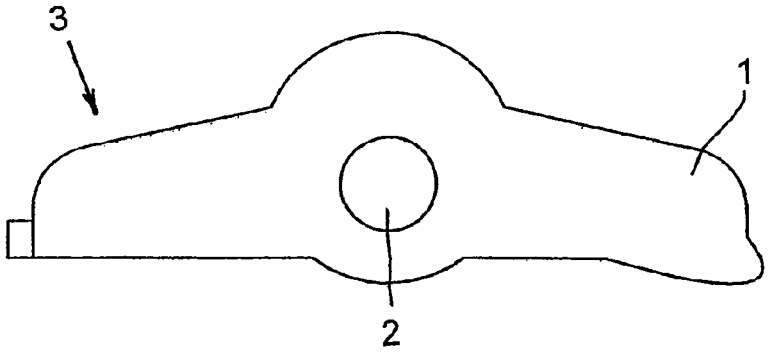
FIG. 1 is a schematic lateral view of a cam follower.
Figure 2:
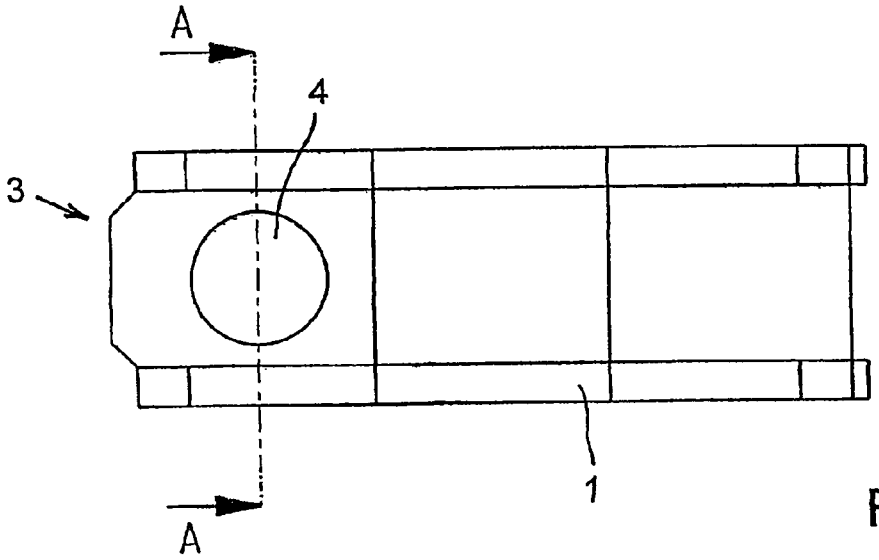
FIG. 2 is a top view of the cam follower, according to FIG. 1.
Figure 3:
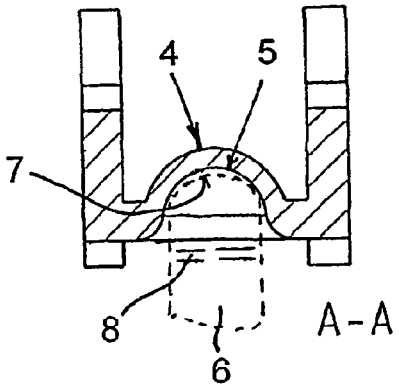
FIG. 3 is a cross-sectional view A-A, according to FIG. 2.

FIGS. 1 to 3 show a control lever, designed as a cam follower 1, of a mechanical valve controller of an internal combustion engine which is, in essence, known and which was described above. This cam follower 1 may pivot around an axis of rotation 2 and it exhibits a supporting section 3, in which a spherical top side 4 of a calotte-shaped recess 5 is provided between two wall sections of the cam follower 1.

As can be gathered, in particular, from the cross section A-A through the cam follower 1 in FIG. 3, the calotte-shaped recess 5 receives a support element 6 for the cam follower 1 which support element is designed, in this case, as an axially movable piston of a piston-cylinder configuration which is not shown in detail.

The support element 6 exhibits a spherically shaped top side 7 which fits precisely into the calotte-shaped recess 5 of the cam follower 1. Below this top side 7, there is an undercut 8 in the support element 6 with said undercut serving to receive the retaining element 9 shown in FIG. 4.

This retaining element 9 is designed, in this case, as a sheet metal component and is provided with an upper leg 10 as well as a lower leg 11 which are connected to each other via a connecting section 12.

Figure 4:
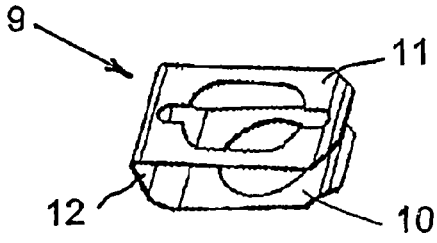
FIG. 4 is a perspective view from above of a retaining element for connection of a cam follower with a support element.

As illustrated by the perspective view of the retaining element 9 in accordance with FIG. 4, geometrically closed openings are provided in the two legs 10, 11. Their function is explained in reference to FIGS. 5 to 7.

What is important is that the opening in the upper leg 10 is essentially circular and the opening in the lower leg 11 is essentially slot-shaped. It is also revealed that the material ridges on both sides of the elongated opening in the lower leg 11 engage into the undercut 8 of the support element 6, while the circular opening in the upper leg 10 is supported by the spherical top side 4 of the cam follower 1.

Figure 5:
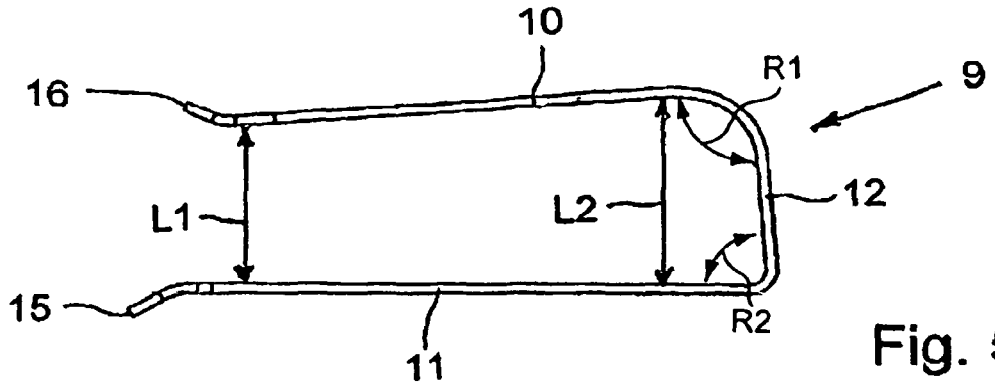
FIG. 5 is a side view of the retaining element in accordance with FIG. 4.

As shown especially in FIG. 5, the retaining element 9 consists of a bent and smooth-surfaced sheet metal, with a connecting section 12 connecting a top leg 10 and a bottom leg 11. As can be easily gathered from this figure, the retaining element 9 is shaped from a flat sheet metal piece such that the bending or connecting radius R2 between the lower leg 11 and the connecting section 12 is smaller than the bending radius or connecting radius R1 between the connecting section 12 and the upper leg 10. In the assembled state, this has the effect, on the one hand, that the retaining element 9 is seated closely against the cam follower 1, and on the other hand, it serves to make sure that the connecting section 12 bends forward to produce an increased bear-on pre-tension in the direction of the spherical top side 4 of the cam follower.

FIG. 5 also discloses that the retaining element 9 is shaped such that the distance L2 between the upper leg 10 and the lower leg 11 in the area of the connecting section 12 is greater than the distance L1 in the area of the free ends 15, 16 of these legs. This non-parallel orientation of the two legs 10, 11 has the effect of a further increased mechanical pre-tension of the retaining element 9 for the connection of cam follower 1 and support element 6.

FIG. 5 also shows that the free ends 15, 16 of the two legs 10, 11 point away from each other, which facilitates the assembly of this retaining element for the pivotable and captive connection of a control lever 1 with the support element 6.

Figure 6:
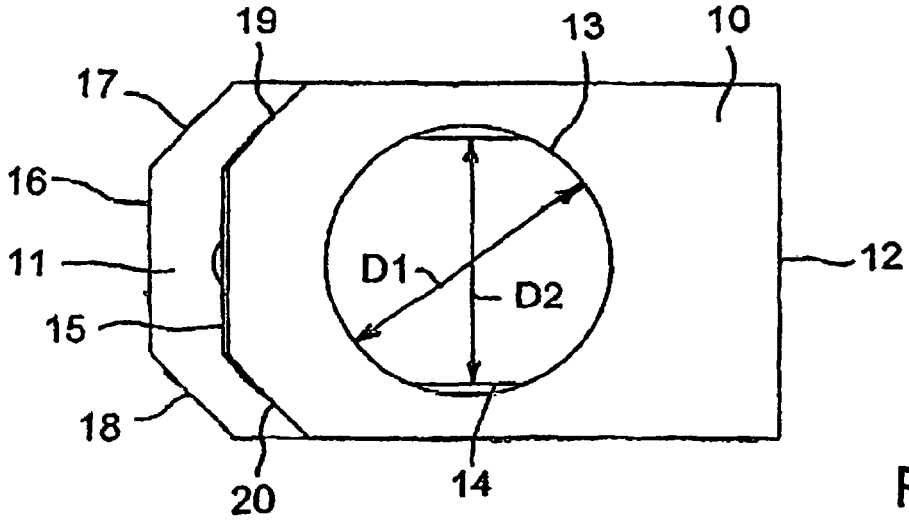
FIG. 6 is a top view of the retaining element in accordance with FIG. 4.
Figure 7:
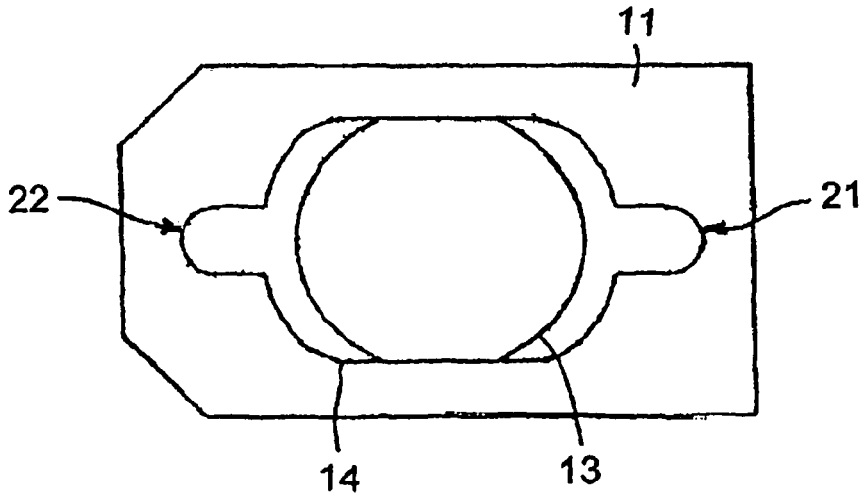
FIG. 7 is a bottom view of the retaining element in accordance with FIG. 4.

As can be gathered especially from FIGS. 6 and 7, the receiving openings in the two legs 10, 11 of the retaining element 9 exhibit different diameters and geometries, with the two openings, however, not being bifurcated, and have a geometrically closed design. Thus, the opening 13 in the upper leg 10 has an essentially circular geometry which has the effect that the spherically shaped top side 4 of the supporting section 3 of the cam follower 1 is securely received in this position or the retaining element 9 can be securely supported in this position.

In contrast, opening 14 in the lower leg 11 is essentially slot-shaped and has, in the embodiment presented here, a stadium-like design with two essentially parallel opening sections being connected via two semi-circular opening sections. As shown in FIG. 7, the semi-circular opening sections are provided with additional slot-type extensions 21, 22, which ensure that the support element 6 is easily put over and this lower leg 11 and is effortlessly clipped into its undercut 8.

It is also revealed that there are lead-in chamfers 17, 18, 19, 20 provided on the free ends 15, 16 of the two legs 10, 11, allowing easy insertion of the retaining element 9 between the side walls of cam follower 1 with these side walls being particularly readily identifiable in FIG. 3.

As shown in FIG. 6, the diameter D1 of the opening 13 in the upper leg 10 was selected such that it is greater than the width of the opening D2 in the lower leg 11 at a right angle to its longitudinal extension. This combination has the effect that, given a preset undercut depth, a sufficient retention on the spherical top side of the cam follower is achieved, or that, given a preset diameter of this opening 13 on the top side of the cam follower 1, a sufficiently large undercut depth is utilizable.

And finally, FIGS. 5 to 7 show that the upper leg 10 is axially shorter than the lower leg 11. This has the advantageous effect of a weight and cost reduction as compared to legs of equal length, while the secure retention on the spherical top side 4 of the supporting section 3 of the cam follower 6 is ensured even if the retaining element 9 does not precisely envelop, with the opening 13 of its upper leg 10, the pole area of the spherical top side 4 of the supporting section 3 or if it does not have an approximated spherical shape.

Furthermore, the slightly longer design of the lower leg 11 makes possible a comparatively long slot-shaped opening 14 promoting the centering of the retaining element 6 and the cam follower 1.

The invention claimed is:

1. A connection device for a pivotable and captive connection of a control lever (1) and an associated support element (6) of a valve controller of an internal combustion engine comprising a supporting section (3);

a calotte shaped recess (5) disposed in the supporting section (3);

a support element (6) being located in the calotte shaped recess (5);

a spherical end (7) of the support element (6) being located in said recess (5);

an undercut (8) is provided below the spherical end (7) of the support element (6);

a spherical top side (4) disposed in the supporting section (3) above the calotte-shaped recess (5), wherein the spherical top side (4), and the supporting section (3) form a control lever (1);

an upper leg (10);

a lower leg (11);

a connecting section (12) connecting the upper leg (10) to the lower leg (11);

an upper geometrically closed opening (13) is furnished in the upper leg (10) to receive the spherical upper side (4) of the supporting section (3) of the control lever (1);

a lower geometrically closed opening (14) is furnished in the lower leg (11) to receive the undercut (8) of the support element (6);

wherein the upper opening (13) in the upper leg (10) is essentially round and wherein the lower opening (14) in the lower leg (11), is associated with the support element (6), and is essentially slot-shaped, wherein the lower opening (14) in the lower leg (11) exhibits a stadium-like geometry, with two parallel opening sections being connected via semi-circular opening sections, and wherein the upper leg (10), the lower leg (11), the connection section (12) form a retaining element (9), wherein the retaining element (9) exhibits a U-shaped cross-sectional geometrical form, and wherein the retaining element (9) connects the control lever (1) and the support element (6).

2. The connection device according to claim 1, wherein the control lever (1) is furnished as a cam follower.

3. The connection device according to claim 1, wherein the support element (6) is furnished as a piston movable in an axial direction.

4. The connection device according to claim 1, wherein the retaining element (9) exhibits a material thickness which is below the axial width of the undercut (8) so that this retaining element (9) is freely movable in all pivot positions of the control lever (1) in the undercut (8).

5. The connection device according to claim 4, wherein the upper leg (10), the lower leg (11) and the connecting section (12) of the retaining element (9) are smooth-surfaced.

6. The connection device according to claim 1, wherein the upper leg (10) of the retaining element (9) exhibits upper lead-in chamfers (19,20) in the area of an upper free end (15); and wherein the lower leg (11) of the retaining element (9) exhibits lower lead-in chamfers (17, 18) in the area of a lower free end (16).

7. The connection device according to claim 6, wherein the upper free end (15) of the upper leg (10) point away from the lower free end (16) of the lower leg (11) and wherein the lower free end (16) of the lower leg (11) point away from the upper free end (15) of the upper leg (10).

8. The connection device according to claim 1, wherein the lower leg (11) has at least one of the semi-circular opening sections.

9. The connection device according to claim 1, wherein the upper opening (13) in the upper leg (10) is of such size that the upper leg (10) is securely supported on the spherical top side (4) of the supporting section (3) of the control lever (1).

10. The connection device according to claim 9, wherein the width (D2) of the opening (14) in the lower leg (11) at a right angle to its longitudinal extension is smaller than the diameter (D1) of the upper opening (13) of the upper leg (10).

11. The connection device according to claim 10, wherein the width (D2) of the lower opening (14) in the lower leg (11) at a right angle to its longitudinal extension is smaller than the diameter of the support element (6) above and below the undercut (8).

12. The connection device according to claim 1, wherein the upper leg (10) is axially shorter than the lower leg (11).

13. The connection device according to claim 1, wherein a connection radius of curvature between the lower leg (11) and the connecting section (12) is smaller than the connection radius of curvature between the connecting section (12) and the upper leg (10).

14. The connection device according to claim 1, wherein the distance between the lower leg (11) and the upper leg (10) near the connecting section (12) is greater than in the area of the upper free end (15) of the upper leg (10) and of the lower free end (16) of the lower leg (11).

15. The connection device according to claim 1, wherein a connection radius of curvature between the lower leg (11) and the connecting section (12) is smaller than the connection radius of curvature between the connecting section (12) and the upper leg (10); and wherein the distance between the lower leg (11) and the upper leg (10) near the connecting section (12) is greater than in the area of the free end (15,16) of the two legs (10,11).

16. A connection device for a pivotable and captive connection of a control lever (1) comprising an associated support element (6) of a valve controller of an internal combustion engine, wherein the control lever (1) exhibits a calotte-shaped recess (5) in a supporting section (3), with a spherical end (7) of the support element (6) being located in said recess, wherein an undercut (8) is provided below the spherical end (7) in the support element (6), wherein the control lever (1) exhibits a spherical upper side (4) in the supporting section (3) above the calotte-shaped recess (5), and wherein a retaining element (9) connects the control lever (1) and the support element (6), with the retaining element (9) exhibiting a U-shaped cross-sectional geometry with an upper leg (10) and a lower leg (11) are connected to each other by a connecting section (12), and wherein a lower geometrically closed opening (14) is provided in the lower leg (11) to receive the undercut (8) of the support element (6) and wherein an upper geometrically closed opening (13) is provided in the upper leg (10) to receive the spherical upper side (4) of the supporting section (3) of the control lever (1), wherein the opening (13) in the upper leg (10) is essentially round and wherein the opening (14) in the lower leg (11), associated with the support element (6), is essentially slot-shaped.

17. The connection device according to claim 16, wherein the legs (10, 11) of the retaining element (9) exhibit lead-in chamfers (17, 18, 19, 20) in the area of their free ends (15, 16);

wherein the free ends (15,16) of the legs (10,11) point away from each other;

wherein the opening (14) in the lower leg (11) exhibits a stadium-like geometry, with two parallel opening sections being connected via semi-circular opening sections.

18. The connection device according to claim 16, wherein the legs (10, 11) of the retaining element (9) exhibit lead-in chamfers (17, 18,19, 20) in the area of their free ends (15,16); and wherein the opening (13) in the upper leg (10) is of such size that this leg is securely supported on the spherical top side (4) of the supporting section (3) of the control lever (1).

19. The connection device according to claim 16, wherein the width (D2) of the opening (14) in the lower leg (11) at a right angle to its longitudinal extension is smaller than the diameter (D1) of the opening (13) of the upper leg (10);

wherein the width (D2) of the lower opening (14) in the lower leg (11) at a right angle to its longitudinal extension is smaller than the diameter of the support element (6) above and below the undercut (8); and wherein the upper leg (10) is axially shorter than the lower leg (11).

* * * * *